US005464219A

United States Patent [19]

Bradford et al.

[11] Patent Number: 5,464,219

[45] Date of Patent: Nov. 7, 1995

[54] TEE MARKER AND METHOD OF PROVIDING TEE TO GREEN CENTER DISTANCE

[76] Inventors: H. William Bradford, 39 County Rd., Essex, Mass. 01929; Peter E. Carr, 82 Brow Ave., Braintree, Mass. 02184

[21] Appl. No.: 363,731

[22] Filed: Dec. 23, 1994

[51] Int. Cl.[6] ..... G09F 11/02; A63B 67/02

[52] U.S. Cl. ..... 273/176 L; 273/32 H; 40/503

[58] Field of Search ..... 40/493, 495, 503, 40/504, 505; 273/176 L, 176 R, 176 A, 32 H, 32 R, 32 B

[56] References Cited

U.S. PATENT DOCUMENTS

| | | | |
|---|---|---|---|
| D. 235,743 | 7/1975 | Izenzon | D10/99 |
| D. 312,292 | 11/1990 | Retacco et al. | D21/234 |
| D. 339,753 | 9/1993 | Dionne | D10/46.1 |
| 1,832,947 | 11/1931 | Sears et al. | 273/32 H |
| 2,421,513 | 6/1947 | Lofstrom | 40/503 |
| 2,585,420 | 2/1952 | Ailes | 40/503 |
| 2,629,951 | 3/1953 | Kittridge | 40/503 X |
| 3,434,454 | 3/1969 | Ashton | 40/503 X |
| 3,478,452 | 11/1969 | Bidwell et al. | 40/68 |
| 3,927,613 | 12/1975 | Nantz | 40/503 X |

*Primary Examiner*—George J. Marlo

*Attorney, Agent, or Firm*—Ernest V. Linek

[57] ABSTRACT

The present invention provides an adjustable distance golf course tee marker which can be used, either singularly (with a non-adjustable marker) or in pairs to define a teeing ground, especially as described in Rule 11 of the Rules of Golf. One unique feature of the adjustable distance tee marker (ADTM for short) of this invention is that unlike prior art devices, it requires a minimum of operating parts, namely:

a. an openable hollow housing having a top portion and a bottom portion;

b. three parallel positioned movable numbered drums, each bearing the numbers 0, 1, 2, 3, 4, 5, 6, 7, 8, and 9 in a spaced apart relationship, wherein said drums are situated in the interior of said housing, and wherein said drums interact with either the top or the bottom (or both) interior shapes of said housing to fix the positions of said drums in said housing;

c. a window void in said housing which provides a means of viewing one number on each of the three drums in said housing, the combination of such numbers representing the yardage distance from the tee marker to the center of the putting green to be played; and d. a spike emanating from the bottom of said housing for attaching or mounting said housing to the teeing ground turf.

21 Claims, 8 Drawing Sheets

TEE MARKER AND METHOD OF PROVIDING TEE TO GREEN CENTER DISTANCE

CROSS REFERENCE TO RELATED DOCUMENTS

The present invention is the subject matter of two Disclosure Documents (Nos. 354398 and 358338) filed in the USPTO by the present inventors on May 19, 1994 and Jul. 25, 1994, respectively. The entire contents of these two Disclosure Documents are hereby incorporated herein by reference. A related design patent application, U.S. Ser. No. 29/031,371 was filed by the present inventors on Nov. 23, 1994. The disclosure of the design application is likewise hereby incorporated herein by reference.

FIELD OF THE INVENTION

This invention is directed to tee markers used in the game of golf, and in particular, to tee markers which accurately reflect the distance from the teeing ground to the center of the putting green.

BACKGROUND OF THE INVENTION

On a typical golf course, there will be several different teeing grounds for each hole, e.g., the forward or "ladies" teeing ground, the standard "mens" teeing ground, and the "championship" teeing ground. These areas are typically marked with different colored tee markers, e.g., red for the ladies, white and/or blue for the men, and gold for the championship tees. For each of these teeing grounds, there is a stated distance, usually measured from the center of the teeing ground to the center of the putting green. This is the distance that is posted on the score card and on the yardage/par sign present at each hole. However, due to wear patterns in the teeing grounds, golf course superintendents constantly move the actual tee markers either forward or back at each teeing ground. The distance that the tee markers is moved can often be significant. Thus, many golfers will want to know the exact distance to the hole, or to some trouble area on the course, e.g., sand traps, water hazards, etc., and these golfers will attempt to calculate the actual distance for each hole. This procedure can take time, particularly if the course is one that the golfer has not played before. This procedure thus results in added time spent on each teeing ground (particularly at par 3 holes), which over a short time adds up and causes the round of golf to be longer than necessary.

It is interesting to note that while many connected with the game of golf recognize that slow play is a major problem, the fact that distances are not accurately provided on signs and score cards, thus requiring valuable time to be wasted in attempting to determine these distances, has not been recognized as part of the problem of slow play. Rather, the movement of tee markers due to the wearing of the teeing ground turf, and the consequent requirement of golfers having to determine these distances has been simply accepted through custom over the years by many in the golfing community.

The present invention addresses and diminishes this problem by providing the golf superintendent with an adjustable distance tee marker. Using the tee marker of the present invention, the actual distance from the center of the putting green to any spot on the teeing ground can be instantly conveyed to the players. The superintendent (or ranger, etc.) simply adjusts the distance numbers present in the tee marker and places the adjusted marker (or a pair thereof) in the ground at each teeing ground. Golfers seeing the actual yardage reflected on the tee markers will not waste their time trying to calculate the yardage themselves. By use of the adjustable distance tee marker (ADTM) of the present invention, the time spent on a round of golf can be reduced.

Prior to this invention, the present inventors were not aware of any commercial embodiments of tee markers which accurately reflected the distance from the teeing ground to the center of the putting green. A search of the USPTO records yielded only two references:

(1) U.S. Pat. No. 3,478,452, entitled "Visual Aid for Golf"; and (2) U.S. Pat. No. 1,832,947, entitled "Golf Marker".

The main purpose of U.S. Pat. No. 1,832,947 is to provide information to the golfer concerning the location of the cup on the putting green. It also provides a freely rotatable distance marker means used to indicate the variable distance from the teeing ground to the cup on the putting green. The distance provided on this marker, therefore, is specifically different than the official distance desired by golf course committees (from the teeing ground to the center of the putting green) and provided by the ADTM of the present invention.

U.S. Pat. No. 1,832,947 also has nine (9) elements and twenty-four (24) parts (for example, its four anchoring stakes would represent one element and four parts), and is too complicated to be manufactured in the required numbers to be a commercial success. As discussed above, the average golf course employs three classes of tees which would require a total of 108 tee-markers. The cost of manufacturing these tee-markers would have been prohibitive and is probably why they are not in use in the game of golf today.

U.S. Pat. No. 3,478,452 is directed to a single tamper proof sign, to be used (as a single unit) at each hole on the golf course, and which includes rotatable distance indicators used to show the distances for each teeing ground (e.g., championship, mens, ladies), which are changed by use of a magnetic key. Only one sign is employed for each hole, and the three common tee distances are all reflected in the magnetically rotatable numbers provided in the sign. This single device is not useful as a tee marker, but is instead used as a variable distance sign for each individual hole. It is not a tee marker, because it is not used to define the teeing ground. Users of this device still must use conventional tee markers to define the teeing ground for championship play, regular mens play and ladies play. When any of the actual tee markers are moved, the sign yardage must be adjusted accordingly by use of a special magnetic key.

The Adjustable Distance Tee Marker (ADTM) of the present invention would enable the actual tee markers to show the actual distance from the teeing ground to the center of the putting green, thereby enabling golf course committees (and/or other course officials) to more "accurately define" the course, as required by Rule 33-2 of the Rules of Golf. Golf Course Committees obviously wish to provide golfers with these distances and they traditionally do so by recording the distances on signs at each hole and also on scorecards. But, as explained above, by virtue of the continuous movement of traditional tee markers, these distances are not "accurately defined," as intended in the Rules of Golf. The ADTM of the present invention has been approved for use by the United States Golf Association as a device which "accurately defines" the official distance of the hole.

The ADTM of the present invention would also address a major problem in playing golf, slow play. Its use would eliminate the necessity of golfers having to take the time to (1) locate the single fixed official distance marker for each hole (which can be difficult to find), (2) pace off the distance to the new position of the tee markers, (3) do the mental calculation to determine the new distance and (4) usually discuss and confirm this distance with other golfers in the group. Other golfers in the group may also take time to verify this distance calculation. The use of the ADTM of the present invention should eliminate time taken by golfers who would otherwise wish to personally determine the accurate distance from the teeing ground to the center of the putting green.

The ADTM of the present invention would also add to the enjoyment of the game by removing the uncertainty of the distances in golfers minds thereby improving some golfers ability to play the game. For example, some "average" golfers do not know that the distances recorded on score cards and signs at the tees are not true representations of the distances from the tee markers to the centers of putting greens. Readily available knowledge of the exact distances from the tee markers to the centers of putting greens, in the form of the ADTM of the present invention, should improve each players ability, provide more time for playing golf rather than using it to perform what should be recognized as an unnecessary distance measuring task, and consequently add to a golfers' enjoyment of the game.

SUMMARY OF THE INVENTION

Thus, the present invention provides an adjustable distance golf course tee marker which will be used, either singularly, (i.e., in conjunction with a plain tee marker) or in pairs, to define a teeing ground, specifically as described in Rule 11 of the Rules of Golf. The adjustable distance tee marker (ADTM for short) of this invention comprises:

a. an openable hollow housing having a top portion and a bottom portion;

b. three movable numbered drums, each bearing the numbers 0–9 in a spaced apart relationship on the face of the drum, wherein said drums are situated in the interior of said housing, and wherein said drums interact with one (or both) of the top and bottom interior shapes of said housing to fix the positions of said drums in said housing;

c. a window void in said housing which provides a means of viewing one number on each of the three drums in said housing, the parallel combination of such numbers representing the yardage distance from the tee marker to the center of the putting green to be played; and d. a spike emanating from the bottom of said housing for attaching said housing to the teeing ground turf.

Preferably, the ADTM of the present invention may further be provided in the shape and form of a golf ball, i.e., a white sphere with a dimpled surface. In one especially preferred embodiment, the ADTM, having the shape and surface characteristics of a golf ball, is further mounted on a proportionally sized golf tee, so that the overall tee marker appears as a golf ball ready to be hit from the teeing ground.

More preferably, the shape of ADTM is in direct proportion to that of an actual golf ball, at about three times actual size (i.e., about six (6) inches in diameter) and includes shallow dimples around nearly the entire outer surface area or perimeter. If desired, a dimpleless space (i.e., no dimples) can be provided at or near the equator (or center) of the ADTM, providing a convenient space for placement of advertising, or other desired information. When mounted on a proportionally sized golf tee, the ADTM is aesthetically appropriate for use on a teeing area. Using a proportionally sized golf tee as part of the mounting device provides a convenient location for using color to define the various teeing areas, e.g., gold tees for the championship teeing area, white and/or blue tees for the men's teeing area, and red tees for the ladies teeing area. Alternatively, the ADTM housing can be painted (or molded) in the desired teeing area colors.

The window void, or viewing area employed on the ADTM of the present invention may be of any convenient geometrical shape, so long as the yardage numbers on the three rotatable drums will be visible therethrough. In the preferred embodiment, the shape of the window void is rectangular, since the three numbered faces of the decagon shaped drums are wider than they are tall. Advantageously, one or more sides of the window void may be beveled (at least the top edge) to better enable the golfer to read the numbers displayed through the window void when he or she is standing in the teeing area. Preferably, all four edges of the rectangular window area are beveled, thereby promoting ease of viewing the numbers displayed in the window void from any location by golfers or other viewers, e.g., television cameras; golf spectators, and the like.

As described above, the ADTM of the present invention uses the cooperating shapes of the interior of the housing, together with the shapes of the three movable numbered drums, to lock the yardage numbers in place. In its most preferred embodiment, the ADTM of the present invention has only three different parts; the hollow housing, three identically shaped numbered drums, and a spike for attachment to the ground. Unlike the prior art devices, no axle is used or required; no external or additional locking mechanism is required; and no moveable parts, other than the three numbered drums are required or used.

To change the yardage information in the preferred ADTM of the present invention, one needs to simply open the housing, then physically rotate each drum so that the desired number is seen through the window void. The housing is then closed, locking the numbers in place. In the preferred embodiment, the numbered drums are decagon shaped, i.e., they have ten (10) equally shaped and sized faces, bearing one of the numbers 0 through 9 on each face. Thus when viewed side by side through the window void, the possible yardage values range from 000 to 999. In order to adjust the distance to reflect the desired yardage, one merely lifts each decagon drum from the bottom housing, thereby freeing the decagon drums from their positions in the housing and turning them by hand until the appropriate yardage shows through the window void, then replacing the drums in desired positions in the housing where they are again kept in place by the cooperating structural design of the inside of the housing.

The skilled artisan will recognize that either the top portion of the housing, or the bottom portion of the housing can be used to provide the locking mechanism for the numbered drums. In the preferred embodiment of the present invention, both halves of the housing are shaped to complementarily lock the decagon shaped drums in place.

The ADTM of the present invention represents a dramatic advance over prior art teeing ground markers. Conventional markers employed in golf today typically have simple geometric designs (round, square, triangular, etc.), but they tell the golfer nothing more than where to stand when teeing off. The prior art devices discussed above, which could have been used to indicate the distance from the teeing ground to the hole, were overly complicated structures, and thus they found no commercial success in the golf world.

The ADTM of the present invention uses the least possible number of structural elements to provide both a defined teeing ground and the useful information of the distance from the teeing ground to the center of the putting green. The basic elements used for the ADTM of this invention include, a top (or right side) housing member, a bottom (or left side) housing member, and three numbered rotatable drums, having the numbers 0–9 spaced apart thereon. Mounting means (e.g., one or more spikes) are preferably provided for securing the ADTM to the ground, but if desired, the ADTM could simply rest directly on the ground at the teeing area, particularly if the bottom housing was flattened slightly to support such a placement.

Preferably the numbers 0–9 used to indicate the yardage distance in the ADTM of the present invention are placed on flat surface faces, e.g., on each face of the decagon shaped drum. This is to be contrasted with the curved numbering displays shown in the two prior art patents discussed above. In the prior art drums, the roundness of the drums could distort the readability of the numbers thereon. Using a flat face provides no such distortion.

By using at least one ADTM of the present invention, together with one conventional tee marker, not only will the teeing ground be defined as required by "Rule 11 Definition" of the Rules of Golf, but the ADTM used at the teeing ground will also convey the official distance to the center of the putting green. This combination of defining the teeing ground and conveying the official distance is believed by the present inventors to be an important part of the novelty of the present invention. The use of a tee marker to also indicate distance, should revolutionize the game of golf to a minor degree, particularly by decreasing factors which contribute to slow play.

Prior to the development the ADTM of the present invention, variable yardage markers were based upon the use of round drums or wheels, placed on axles or spindles, whereby rotation combined with some mechanical means would lock the drums in place. No axle or spindle is required for the preferred numbered drums of the present ADTM, and none is desired. The preferred ten sided or decagon shaped drums are simply turned by hand, e.g., by lifting them very slightly off of the ribs where they rest (in the bottom housing) and rotating them to the desired positions. After the top of the ball is replaced, a rib in the top of the ball locks the drums in place. The shape of the drums melding with the shape of the ribs and angle supports negates the necessity of using an axle or any other mechanical locking system. There are no moving or mechanical parts to accomplish this procedure, rather the present ADTM relies upon the cooperating structural shapes of the housing interior and the shape of each drum, to restrict unwanted movement of the yardage values.

DETAILED DESCRIPTION OF THE PREFERRED EMBODIMENT

Figure 1:
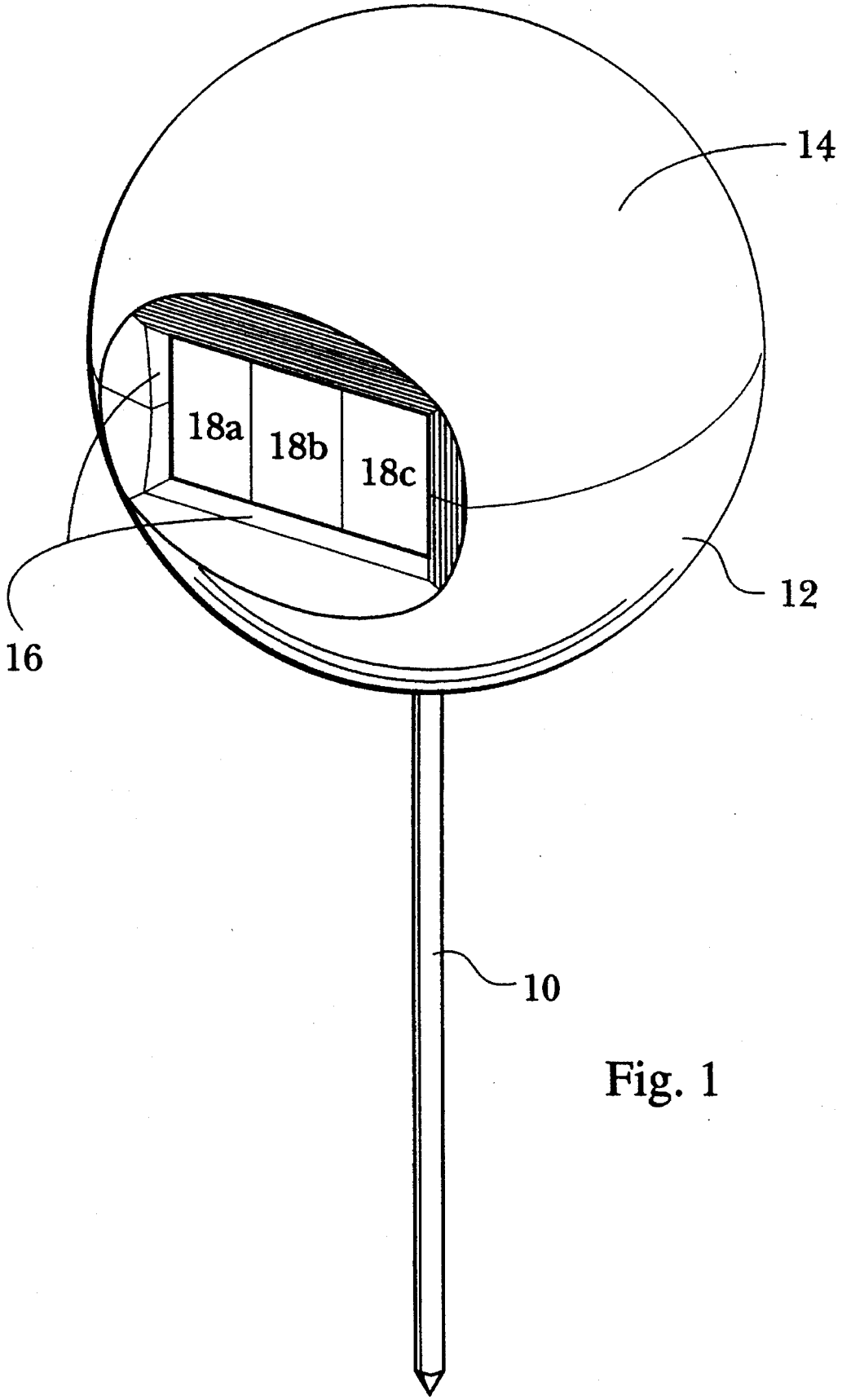
FIG. 1 is a perspective view of one embodiment of the adjustable distance tee marker of the present invention.

As illustrated in the FIG. 1, one embodiment of the ADTM of the present invention has a simple ball shape mounted to a spike 10. The illustrated ADTM housing has two halves, a lower half 12 and an upper half 14, which when joined form window void 16 through which three number bearing drums 18*a*, 18*b* and 18*c* may be viewed by a golfer. As shown in FIG. 1, the housing halves 12 and 14 are beveled at the top, bottom and side edges of window void 16, thereby increasing the visibility of the displayed numbers from varying angles.

Figure 2:
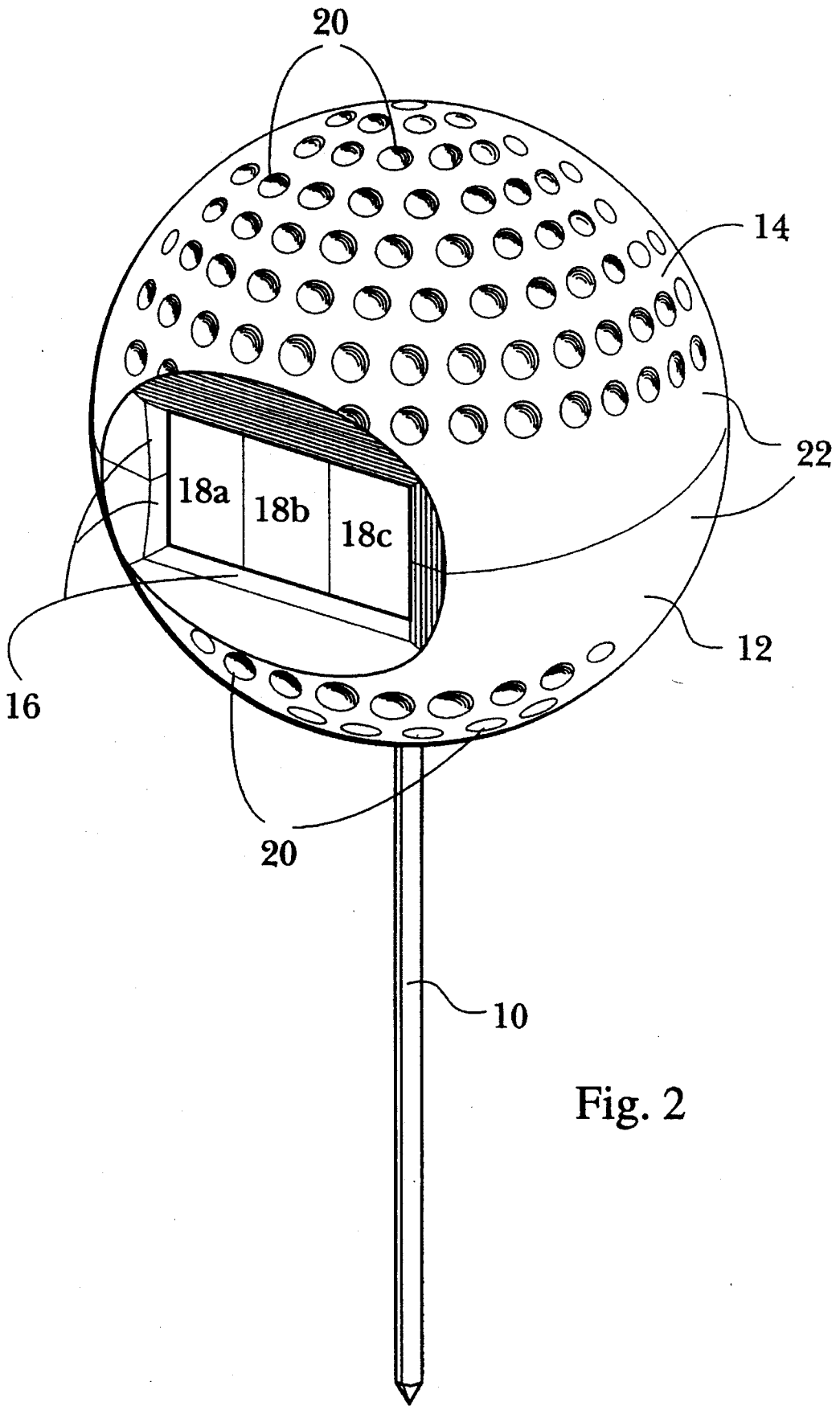
FIG. 2 is a perspective view of another embodiment of the adjustable distance tee marker of the present invention.

FIG. 2 illustrates another embodiment of the ADTM of the present invention, nearly identical to that of FIG. 1, but wherein a majority of the outer surface of housing halves 12 and 14 are provided with depressions 20 having the appearance of golf ball dimples. As illustrated in FIG. 2, a band 22 of no dimples is provided where the two halves 12 and 14 of the housing meet. This band 22 is useful for advertising purposes.

Figure 3:
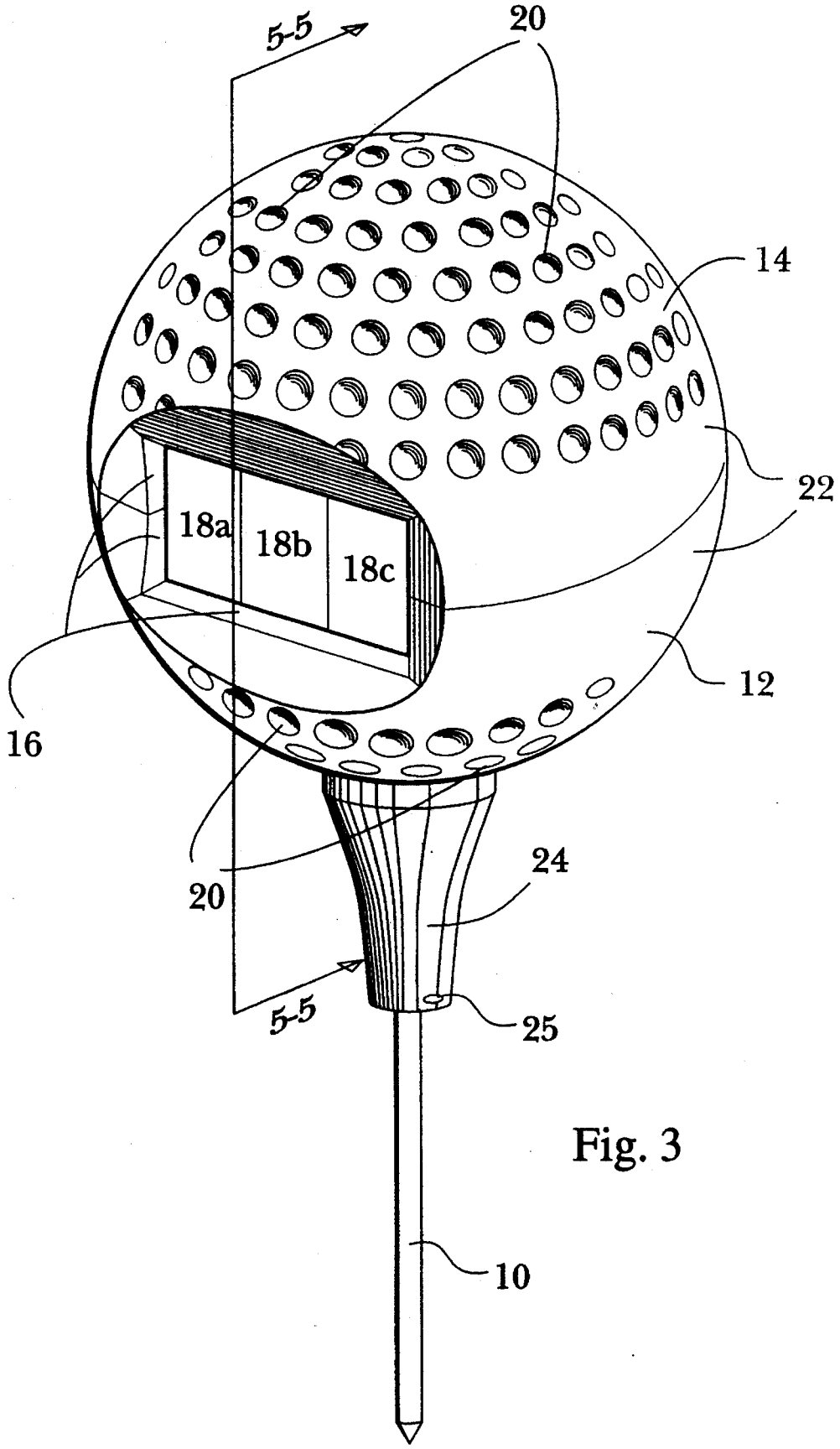
FIG. 3 is a perspective view of the adjustable distance tee marker of FIG. 2, modified to include a golf tee under the ball.

FIG. 3 illustrates the most preferred embodiment of the ADTM of the present invention. Like the embodiments shown in FIGS. 1 and 2, this ADTM has a simple ball shape mounted to a spike 10. As with the embodiment illustrated in FIG. 2, the outer surface of the lower half 12 and an upper half 14 of the housing includes dimples, and further includes the advertising band 22 near the equator. The final modification of this embodiment is the inclusion of a golf tee 24 at (or as a part of) the base of the lower housing 12. The tee 24 (or a part of the body of the housing) may be provided with a drain hole 25, through which water (e.g., from rain, sprinklers, etc.) may drain out of the housing. Preferably, the golf tee is integrally molded with the lower housing 12, i.e., as an integral unit. When this ADTM is placed in the ground by pushing spike 10 completely into the ground, the overall appearance of the ADTM is a golf ball sitting on a golf tee, ready to be hit by a golf club.

Figure 4:
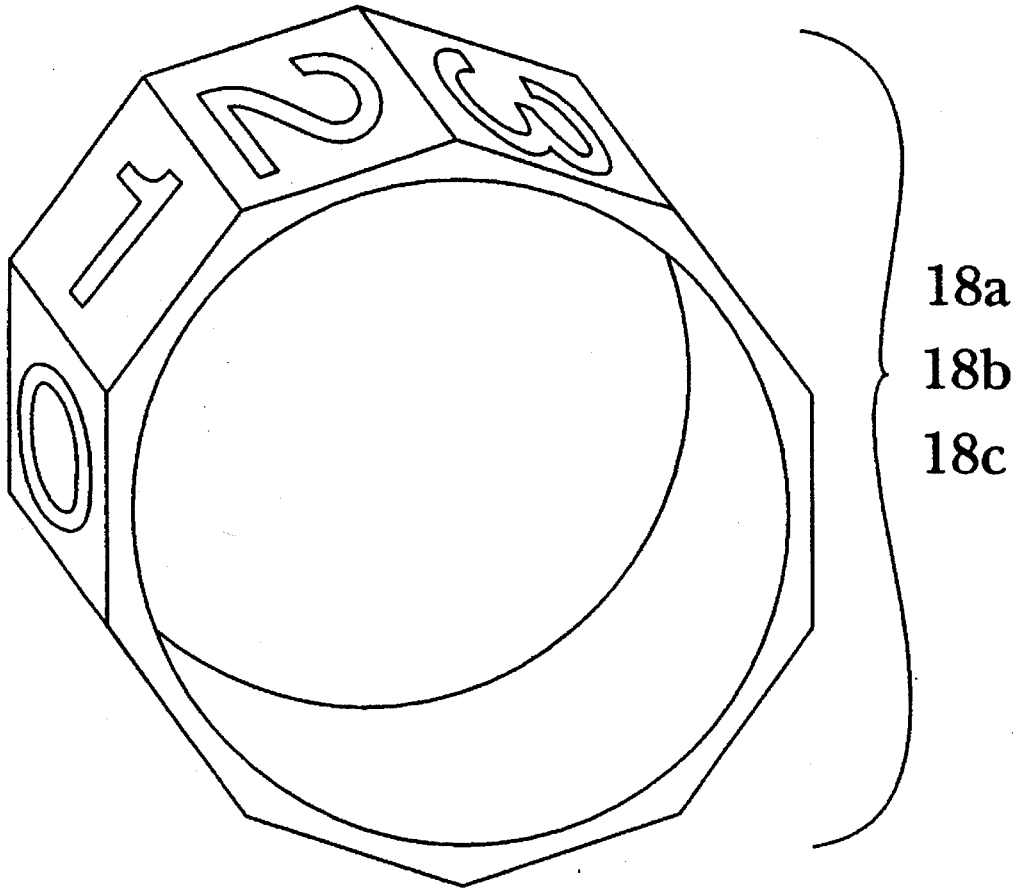
FIG. 4 is a perspective view of one numbered hexagon shaped drum used in the preferred adjustable distance tee marker of the present invention.

FIG. 4 illustrates one version of the hexagon shaped drum, three of which are used in the ADTM of the present invention. See, 18*a*, 18*b*, and 18*c* in FIGS. 1–3. As illustrated, each drum is wide enough to have highly visible numbers (0, 1, 2, 3, 4, 5, 6, 7, 8, and 9) printed, painted, or otherwise applied (one each) to the ten equally shaped and spaced faces. The illustrated drum is a hollow unit, but in preferred embodiments, a stabilizing wall (not shown) is included at either end of the drum, both ends of the drum, or in the center of the drum. Use of such a stabilizing wall provides rigidity to the drums which, depending upon the rigidity of the material used to form the drum, may not be necessary in all cases. The drums, being the only moving part of this invention, should be manufactured from a long lasting, tough wearing material. Suitable materials include high strength plastics, metals, and the like.

Figure 5:
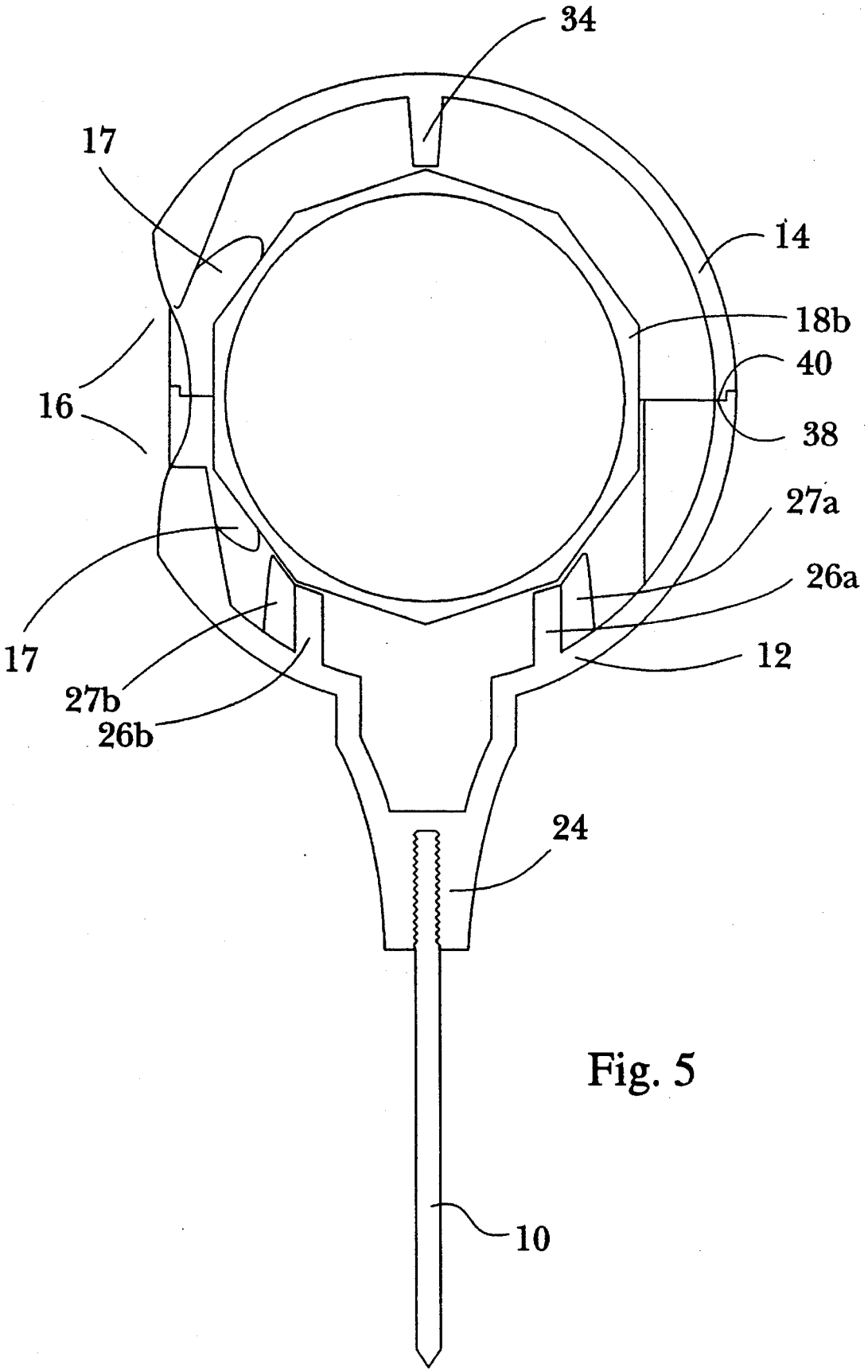
FIG. 5 is a cross-sectional view of the adjustable distance tee marker of FIG. 3, taken along line 5—5.

FIG. 5 is a cross-sectional view of the preferred ADTM of the present invention. All of the components in the preferred version are formed from ¼ inch thick structural foam plastic, but if desired, other materials could be used. As shown therein, lower housing 12 and golf tee 24 are molded as a single unit, and the ground spike 10 is mounted directly to the golf tee 24. Hexagon shaped drum 18*b* is shown in this view and the interior mounting sections of the upper and lower halves of the housing are shown whereby the hexagon shaped drums are locked in place. These mounting sections are discussed below in greater detail with respect to FIGS. 6, 7 and 8. Window void 16 through which three number bearing drums 18*a*, 18*b* and 18*c* may be viewed, is also shown in this Figure. As illustrated, a plastic blocking material 17 is preferably mounted behind the window void to improve the appearance of the numbered drums in the window void 16 and to impede water flow into the unit.

Figure 6:
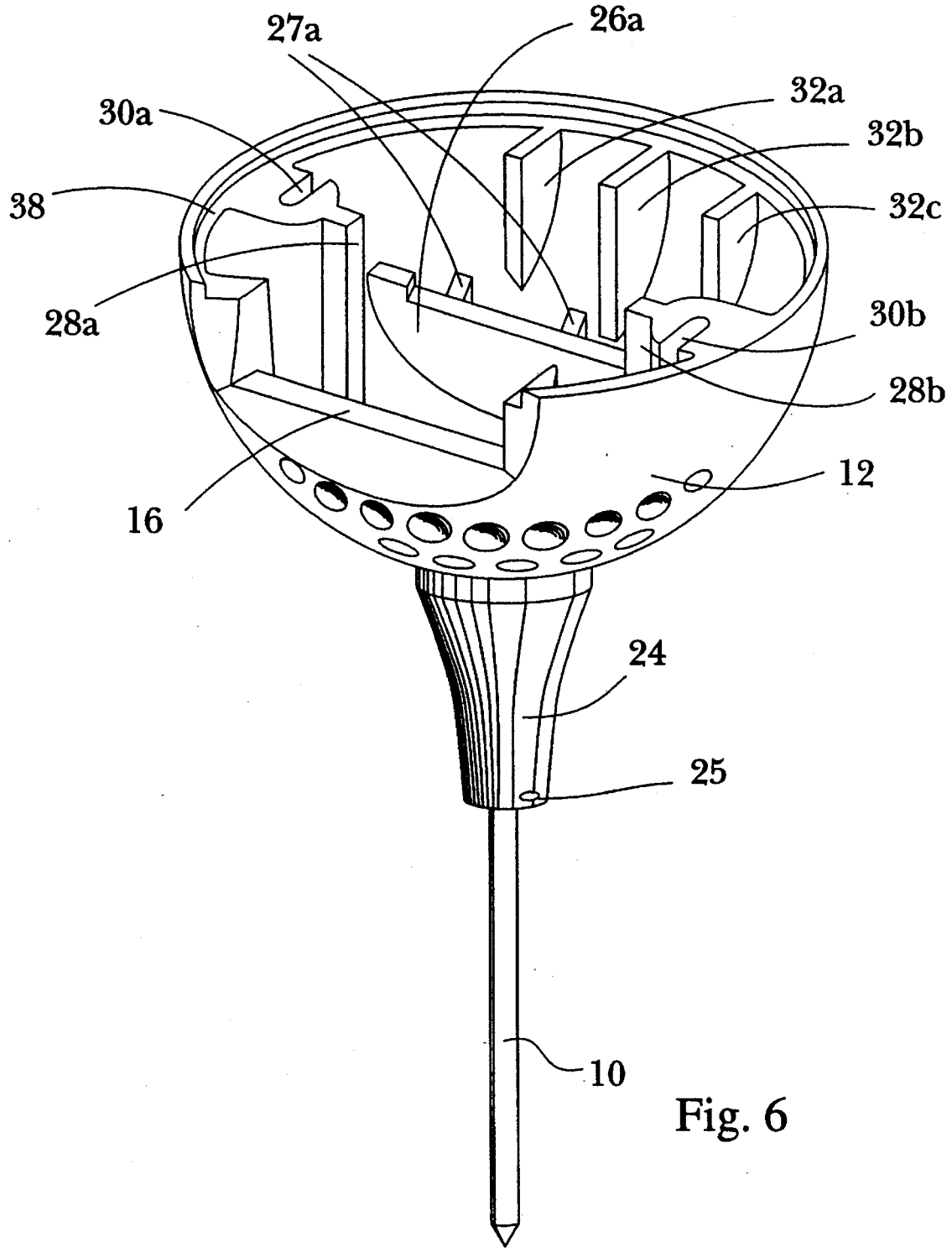
FIG. 6 is a perspective view of the interior of the lower half of the housing for the adjustable distance tee marker of FIG. 3.
Figure 7:
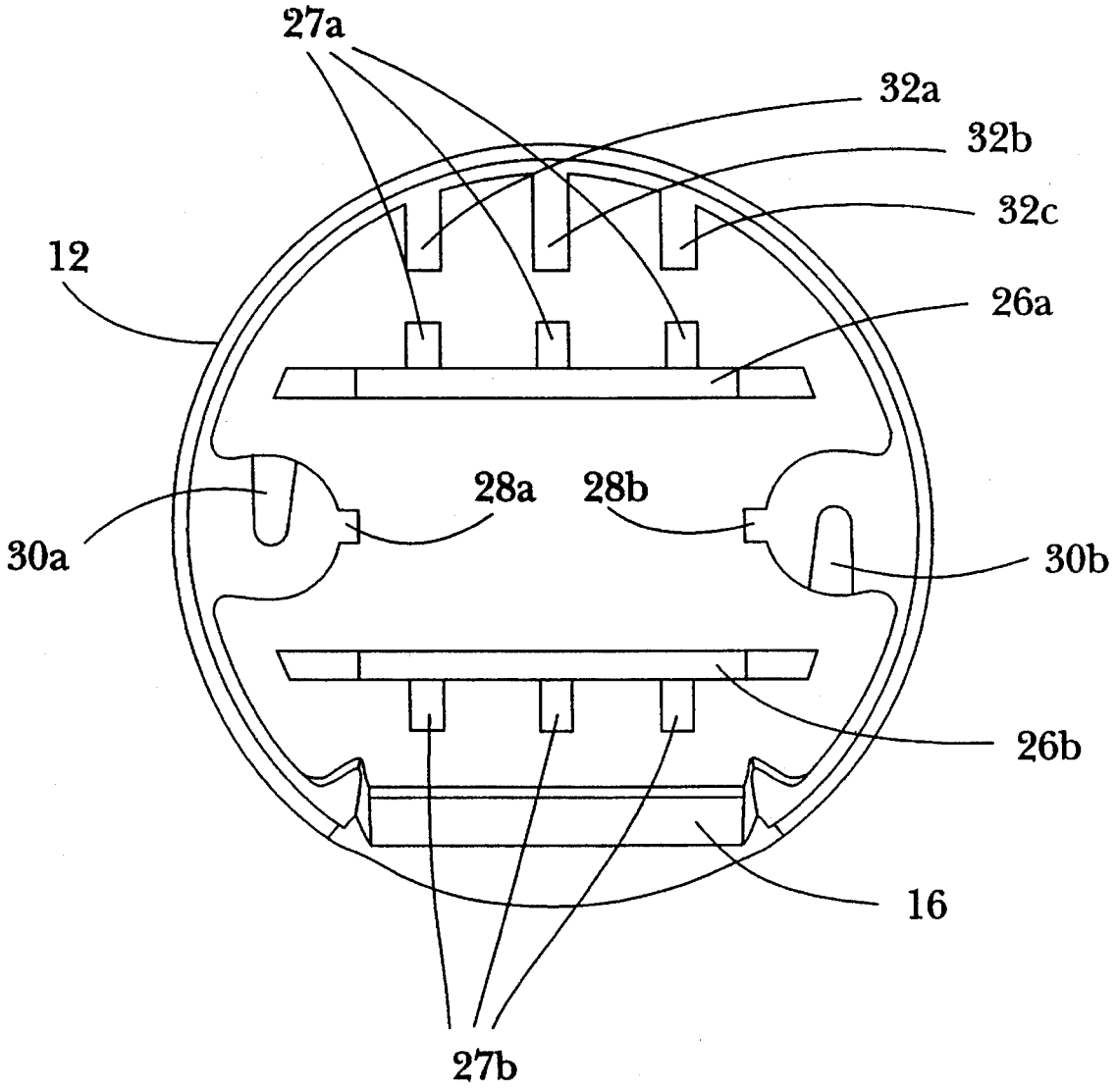
FIG. 7 is a view (looking straight down) of the interior of the lower half of the housing of the preferred adjustable distance tee marker of the present invention.

FIGS. 6 and 7 are detailed views of the lower half of the preferred housing of the ADTM of the present invention, showing the two structural ribs 26*a* and 26*b* with three angle supports 27*a* and 27*b*, two vertical structural ribs 28*a* and 28*b*, two fastener recepticals 30*a* and 30*b*, and three vertical supporting ribs 32*a*, 32*b* and 32*c*. The lower half of the preferred housing also includes one half of a rectangular void which when joined to the upper half of the housing forms window void 16. The mounting ribs shown in these two Figs. stabilize the numbered drums, locking them in place when the upper housing is added. The ribs also prevent side to side motion of the numbers, ensuring a highly visible, easy to read yardage marker. The numbers when viewed through window void 16 are evenly spaced and easy to read.

Figure 8:
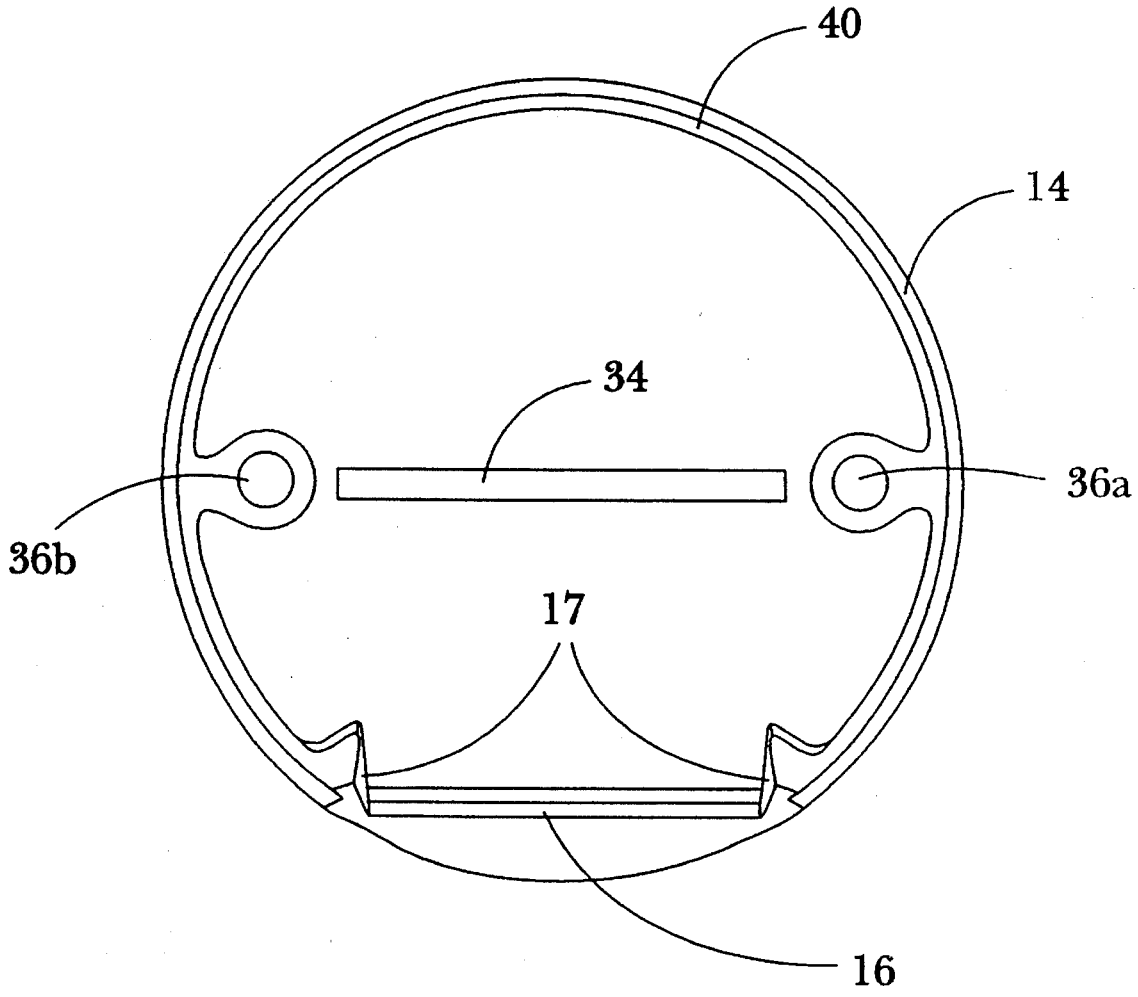
FIG. 8 is a view (looking straight up) of the interior of the upper half of the housing of the preferred adjustable distance tee marker of the present invention.

FIG. 8 illustrates the interior of the top half of the preferred housing of the ADTM of the present invention. The top half of the housing 14 provides the remainder of the window void 16, the remaining locking members 36*a* and 36*b* for joining the two halves of the ball into one unit and a final locking structural rib 34 which rests on top of the decagon shaped numbered drums 18*a*, 18*b*, and 18*c*, preventing the displacement thereof while the housing unit is joined together. Extended rib 40 mates with depressed rib 38 for ease of assembly of the two halves of the housing.

The preferred embodiment of the ADTM of the present invention thus comprises three basic elements:

(a) a steel rod 10 to fix the ADTM in the teeing ground turf, (b) a high strength ¼" structural foam plastic housing, the bottom portion of which includes a golf tee 24, the bottom half of a dimpled ball 12, the interior of which includes two molded structural ribs 26*a* and 26*b* with three molded angle supports 27*a* and 27*b*, two molded vertical structural ribs 28*a* and 28*b*, two fastener recepticals 30*a* and 30*b*, and three molded vertical supporting ribs 32*a*, 32*b* and 32*c*. The lower half of the housing also includes one half of a rectangular void which when joined (to the upper housing) forms window void 16; and the top portion of the housing which includes the top half of a dimpled ball 14, one molded horizontal structural rib 34, two molded fastener protrusions 36*a* and 36*b* (which mate with recepticals 30*a* and 30*b* respectively), the other half of the frame of the rectangular void which forms window void 16, and (c) three numbered decagon shaped or ten-sided drums 18*a*, 18*b* and 18*c*, the ten sides of each being numbered 0 to 9.

The three decagon drums 18*a*, 18*b* and 18*c* are held in place on the housing from the bottom by their resting on the two horizontal structural ribs 26*a* and 26*b* and the three angle supports 27*a* and 27*b*; from the sides by the two vertical structural ribs 28*a* and 28*b*; and from the top by one structural rib 34.

Yardage distances, which are provided by the numbers (0–9) on each of the decagon drums 18*a*, 18*b*, and 18*c*, which are adjusted or changed by rotating the top half of the ball 14 slightly, thereby disengaging the fastener protrusions 36*a* and 36*b* from fastener recepticals 30*a* and 30*b* to remove the top half of the ball 14; then slightly lifting and turning each of the drums 18*a*, 18*b* and 18*c* to reflect the desired yardage distance numbers in window void 16; then replacing the top half of the ball 14 by placing it on the bottom half of the ball 12 and again turning it slightly to re-engage fastener protrusions 36*a* and 36*b* with fastener recepticals 30*a* an 30*b*.

The process of separating and joining the top half of the ball 14 and the bottom half of the ball 12 is facilitated by the incorporation of two lips 38 and 40 on each half of the ball. As shown in FIG. 6, the lip 38 on the lower half of the ball is located on the inside of the outer wall, at a location slightly below the exterior wall. As shown in FIG. 8, the upper half of the ball is provided with a lip 40, on the inside of the outer wall, and this lip extends slightly beyond the length of the outer wall, forming a tight seal with lip 38. If desired, these lips could be reversed, i.e., the extended lip could be provided on the lower half of the ball, and the recessed lip provided on the upper half of the ball. If desired, a drain hole can also be included in the lower half of the ball housing (or as illustrated, in the tee) to allow moisture collected in the housing to be released.

The present inventors have spent a great deal of time and energy on the development of the ADTM of the present invention, including testing and making the desirable structural changes as discussed in greater detail below. The construction of the original model simply utilized a styrofoam housing, balsa wood drums, caulking compound, various types of paint and Velcro® material to attach the styrofoam pieces together. The inside of the styrofoam housing was carved out to form ten sides which melded with the ten sided or decagon drums.

The principle was thus proven for manufacturing an adjustable distance tee marker without any excess mechanical or moving parts. Rather, the Applicants found that one could simply rely upon the cooperating shapes of the housing and the numbered drums to place and fix the yardage distance numbers.

At the Applicant's request and under the Applicant's guidance, a professional model was made by the Beverly Pattern Co., Beverly, Mass. It employed the same principles of using the cooperating shapes of the numbered drums and the housing to place and fix the yardage distance numbers.

The professional model of the ADTM, which will be used with engineering drawings to make the mold for the formation of commercial versions of the present ADTM, is substantially ready for use as manufactured. Only the (1) painting of the tee (e.g., different colors for different teeing grounds), (2) numbering of the decagon drums, (3) placement of the number designating the golf hole and (4) placement of optional advertising remain following molding.

The ADTM of the present invention will be further illustrated with reference to the following test examples which aid in the understanding of the present invention, but which are not to be construed as limitations thereof.

TEST EXAMPLES

Test: Ability to see the ADTM's yardage distance numbers while (1) standing on the teeing area, (2) approaching the teeing area and (3) from the vantage point of a TV camera being used to broadcast a golf tournament.

Test Results:

The ADTM, as originally conceived, had straight, horizontal sight lines on the top, bottom and sides of the housing's window. When standing on a tee it was noted that a player could not easily see the tops of the numbers. The Applicants therefore beveled the top of the window to provide a higher sight line.

The first bevel angle (about 30°) was not high enough to provide adequate viewing of the tops of the numbers. The Applicants therefore beveled the angle a second time increasing the bevel angle to about 62°, which provides sufficient and easy viewing of all of the numbers. The Applicants matched this bevel with a similar beveled angle on the bottom of the window at about 68° for aesthetic purposes.

Straight vertical sight lines on the sides of the window prevented easy viewing of the numbers while approaching the teeing area. Thus, the Applicants also beveled the sides of the window, in a similar manner as described above (about 55°), enabling easier viewing of the yardage numbers while approaching the teeing area from the side and rear. The corners of the window were then rounded for aesthetic purposes.

The Applicants believe that the ADTM of the present invention may be used in particular on golf courses where major tournaments are held. If so, the focusing on the ADTM for distance information would probably become part of the routine of the TV broadcasting of the tournaments. The Applicants wanted to ensure that a TV camera, which might be situated higher, and perhaps to the side and/or rear of the teeing area, would be able to easily view and show the yardage distance numbers on the ADTM. The beveled sides of the window of the ADTM, as described, will accomplish this purpose.

Test: Ease of placing and fixing the decagon drums in the ADTM's housing.

Test Results

When the first model was produced it was found that the three decagon drums had too much lateral movement in the area at the top of the drums. The Applicants turned the first of the three drums so that the flat surface side (not the concave side) was on the outside, thus, flat surfaces were on the outside of the first and third drums. The Applicants then raised the two vertical supporting ribs, bearing against these two flat surfaces, to the height of the equator of housing, which provided excellent support for the drums and prevented the mentioned lateral movement.

To further ensure alignment of the drums, four ¼" high rib sections were added at the tops of the ends of the two longitudinal supporting ribs at the bottom of the housing.

The Applicants also found that relying solely on the two support ribs at the bottom of the housing, including their angle supports, was not sufficient to readily and precisely place the drums in desired positions. Three vertical supporting ribs were added in the side of the housing behind the three drums, the flat surfaces of the ribs bearing against the flat surfaces of the decagon drums. As a result, desired placement of the drums was more easily and precisely achieved.

Test: Physical Appearance of the ADTM

Test Results

In looking at the original styrofoam model, the height of the tee appeared too tall and unrealistic. The Applicants determined that a more normal appearing height of the ADTM tee would result by making a proportionate comparison to how a golf ball was placed on a tee for a driver, i.e., a tee was placed in the ground so that the top of the driver was about half-way up the golf ball. The proportionate calculation resulted in the reduction of the height of the ADTM tee from 3½ inches to 2½ inches, thereby providing a more normal and realistic appearance of the ADTM on the teeing ground.

In viewing the window area, the Applicants also noted that one could see into the inside of the housing at the sides of the window. Thus, the Applicants added plastic material to the sides of the window on the inside of the housing to eliminate this detriment to the appearance of the ADTM.

In the creation of dimples on the surface of the spherical housing, i.e., to mimic the appearance of a golf ball, the Applicants first used a vertical engraving machine which created undesired vertically elongated, or tear shaped dimples, formed at the equator of the sphere [not illustrated]. The Applicants then employed CAD assisted cutting tools to produce the correct, irregularly placed, shallow dimples on the surface of the sphere, achieving the appearance of an actual dimpled golf ball. The dimples were formed on the outside of the plastic housing by using a CNC (Computer Numerically Controlled) machine and a Master C.A.M. program, at the Beverly Pattern Co., Beverly, Mass.

A clear band, i.e., without dimples, surrounds the equator of the model of the ADTM, a result of manufacturing constraints in using the model as a mold in the future manufacture of the ADTM. This is a satisfactory by-product in the development of the present ADTM as the band is a convenient area for advertising use, e.g., golf companies, tournament sponsors, hole sponsors, golf course name, etc.

The types of numbers to be placed on the decagon drums which are used to indicate yardage distances, were also considered. The original numbers used on the styrofoam model, measuring 1 inch in height and a comparatively wide 13/16" in width, were chosen because of their being easy to read.

In its most preferred embodiment, the Applicants intend to have the ADTM manufactured in white plastic using a structural foam plastic process. One plastics manufacturer has stated that the Applicants may have the plastic manufactured as white as desired. The Applicants intend to have the plastic color similar to the white color and gloss of a golf ball. The only painting which will be necessary will be for (1) the tees, to designate the class of the teeing ground, e.g., championship-gold, men's-blue or white, women's red, etc., (2) the yardage numbers, (3) the number of the golf hole which will be placed on the back of the ADTM, and (4) any permanent advertising lettering.

For the model ADTM, the Applicants had the ball painted in a similar color to a golf ball, i.e., gloss white, "Dupli-Color Bright Beauty Lacquer." The tee of the model was painted a deep, somewhat dark, red, i.e., red pattern lacquer, "Freman Fre-Res Pattern Coat 90-1." The Applicants changed the red color of the tee to a glossy, more typical red, nearer to a China Red, which will also match the red numbers put on the back of the ADTM which designate the number of the hole being played.

VARIATIONS OF DESIGN

Instead of using the shape of a golf ball on a tee as the housing for the ADTM of the present invention, many other shapes could be used, e.g., similar to the shapes of basic tee markers in use today, for example, spheres, spheres with dimples but without a tee, rectangles, squares, wedges, cylinders, etc. Also, different methods could be used to rotate and lock the numbered drums in place. One alternative method to rotate and then hold the drums in place would be to use; (1) a plastic axle with an outward tension type ridge that would run the length of the axle and (2) three decagon drums that not only have ten sides on their perimeter but also surround a hollow core in the drums. The outward tension of the axle's ridge would seek the angles of the inner ten sided core and be able to keep the drums in desired positions.

Another design possibility would be to replace the decagon drums with another shape, e.g., round, and utilize other means for locking the numbers in place. External and/or internal locking means could be employed, for example, pins inserted into one or more of the drums to lock the numbers in place.

Finally, if desired, electronic number displays could be used for the yardage distance in the housing of the present invention. The numbers could be changed by either manual contact or remote control.

While these and other ramifications could be easily developed, the Applicants have chosen the above described preferred embodiment of the ADTM of the present invention because of (1) the aesthetic value of its appearance, harmonizing with an actual golf ball and tee used on the teeing ground and (2) the method of adjusting and fixing the drums in place being the most simple and least expensive to manufacture.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. An adjustable distance tee marker (ADTM) comprising a hollow housing containing three independently rotatable drums situated side by side, each drum having the numbers 0, 1, 2, 3, 4, 5, 6, 7, 8, and 9 equidistantly spaced apart on the face of each drum, said housing further comprising a window void through which three parallel positioned numbers on the faces of the three movable numbered drums can be viewed, and wherein unwanted rotational movement of the three numbered drums is restricted by the cooperating shapes of the drums and the shape of the interior of the housing.

2. The ADTM of claim 1, further comprising a mounting means attached to the exterior of the housing case, whereby the ADTM may be fixed in position at a teeing ground.

3. The ADTM of claim 2, wherein the mounting means is a metal spike.

4. The ADTM of claim 3, wherein the mounting means further comprises a golf tee shaped member, which contacts the bottom of the ADTM housing.

5. The ADTM of claim 4, wherein the housing has the shape of a golf ball.

6. The ADTM of claim 5, wherein the golf ball shaped housing further includes dimples on at least about 50% of its surface area.

7. The ADTM of claim 5, wherein the golf ball shaped housing further includes dimples on at least about 75% of its surface area.

8. The ADTM of claim 1, wherein the window void is rectangular in shape.

9. The ADTM of claim 8, wherein the rectangular window void includes at least one beveled edge to aid in the readability of the numbers visible through the window void.

10. The ADTM of claim 9, wherein the rectangular window void is beveled on its four edges.

11. An adjustable distance tee marker (ADTM) comprising in combination:

a. an openable hollow housing having a top portion and a bottom portion;

b. three parallel positioned movable numbered drums, each bearing the numbers 0, 1, 2, 3, 4, 5, 6, 7, 8, and 9 in a spaced apart relationship, wherein said drums are situated in the interior of said housing, and wherein said drums interact with one or both of the top and bottom interior shapes of said housing to fix the positions of said drums in said housing;

c. a window void in said housing which provides a means of viewing one number on each of the three drums in said housing, the combination of such numbers representing the yardage distance from the tee marker to the center of the putting green to be played; and d. a spike emanating from the bottom of said housing for attaching said housing to the teeing ground turf.

12. The ADTM of claim 11, further comprising a mounting means attached to the exterior of the housing case, whereby the ADTM may be fixed in position at a teeing ground.

13. The ADTM of claim 12, wherein the mounting means is a metal spike.

14. The ADTM of claim 13, wherein the mounting means further comprises a golf tee shaped member, which is an integral part of the bottom of the ADTM housing.

15. The ADTM of claim 11, wherein the housing has the shape of a golf ball, positioned on a proportionally shaped golf tee.

16. The ADTM of claim 15, wherein the golf ball shaped housing further includes dimples on at least about 50% of its surface area.

17. The ADTM of claim 15, wherein the golf ball shaped housing further includes dimples on at least about 75% of its surface area.

18. The ADTM of claim 11, wherein the window void is rectangular in shape.

19. The ADTM of claim 18, wherein the rectangular window void includes at least one beveled edge to aid in the readability of the numbers visible through the window void.

20. The ADTM of claim 19, wherein the rectangular window void is beveled on its four edges.

21. A method of adjusting the variable yardage distance information from the teeing ground to the center of the putting green at a golf hole comprising:

utilizing at least one adjustable distance tee marker (ADTM) having a window void through which the variable distance from the teeing ground to the center of the putting green may be viewed, said ADTM comprising a hollow housing containing three movable decagon shaped drums, said drums having one of the numbers 0–9 on each of the ten faces thereof;

adjusting the variable distance from the teeing ground to the center of the putting green by manually rotating each of said decagon shaped drums in said housing such that the desired variable yardage distance may be viewed through said window void; and locking said drums in place by means of cooperative interaction between their decagon shapes and the interior shape of the housing.

* * * * *